US012680142B2

(12) United States Patent
Park

(10) Patent No.: US 12,680,142 B2
(45) Date of Patent: Jul. 14, 2026

(54) STEEL SHEET WITH EXCELLENT SURFACE QUALITY, AND MANUFACTURING METHOD THEREFOR

(71) Applicant: POSCO, Pohang-si (KR)

(72) Inventor: Kyong-Su Park, Pohang-si (KR)

(73) Assignee: POSCO, Pohang-si (KR)

( * ) Notice: Subject to any disclaimer, the term of this patent is extended or adjusted under 35 U.S.C. 154(b) by 747 days.

(21) Appl. No.: 17/799,123

(22) PCT Filed: Feb. 17, 2021

(86) PCT No.: PCT/KR2021/001996

§ 371 (c)(1),
(2) Date: Aug. 11, 2022

(87) PCT Pub. No.: WO2021/167332

PCT Pub. Date: Aug. 26, 2021

(65) Prior Publication Data

US 2023/0087092 A1 Mar. 23, 2023

(30) Foreign Application Priority Data

Feb. 18, 2020 (KR) ..... 10-2020-0019925

(51) Int. Cl.

| | |
|---|---|
| ***C21D 9/46*** | (2006.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/32*** | (2006.01) |
| ***C23G 1/08*** | (2006.01) |

(52) U.S. Cl.

CPC ..... *C21D 9/46* (2013.01); *C21D 8/0226* (2013.01); *C21D 8/0236* (2013.01); *C22C 38/002* (2013.01); *C22C 38/02* (2013.01); *C22C 38/04* (2013.01); *C22C 38/32* (2013.01); *C23G 1/08* (2013.01)

(58) Field of Classification Search

CPC ..... C21D 9/46; C21D 8/0226; C21D 8/0236; C21D 1/02; C21D 3/02; C21D 3/04; C21D 8/02; C21D 8/0278; C21D 8/0294; C21D 8/0436; C21D 8/0478; C21D 8/1261; C21D 8/1272; C22C 38/002; C22C 38/02; C22C 38/04; C22C 38/32; C22C 38/38; C23G 1/08; C23G 3/021; Y02P 10/25

USPC ..... 148/661

See application file for complete search history.

(56) References Cited

U.S. PATENT DOCUMENTS

| | | | |
|---|---|---|---|
| 2012/0241052 A1 | 9/2012 | Kim et al. | |
| 2017/0088914 A1 | 3/2017 | Ikeda et al. | |
| 2017/0369964 A1 | 12/2017 | Fujii et al. | |
| 2017/0369965 A1 | 12/2017 | Keda et al. | |
| 2018/0010226 A1 | 1/2018 | Keda et al. | |
| 2018/0371570 A1* | 12/2018 | Kim | C21D 6/008 |
| 2020/0047231 A1 | 2/2020 | Kofler et al. | |
| 2020/0087751 A1 | 3/2020 | Kim et al. | |
| 2020/0325554 A1 | 10/2020 | Takeda et al. | |
| 2021/0147955 A1 | 5/2021 | Yoo et al. | |
| 2022/0056564 A1 | 2/2022 | Kang et al. | |

FOREIGN PATENT DOCUMENTS

| | | | |
|---|---|---|---|
| CN | 110088343 | A | 8/2019 |
| CN | 110799281 | A | 2/2020 |
| EP | 1195447 | A1 | 4/2002 |
| JP | H05-123739 | A | 5/1993 |
| JP | H07-70635 | A | 3/1995 |
| JP | H108-132124 | A | 5/1996 |
| JP | H10-72686 | A | 3/1998 |
| JP | H11-189885 | A | 7/1999 |
| JP | 2004-331994 | A | 11/2004 |
| JP | 2012-012655 | A | 1/2012 |
| JP | 2014-19902 | A | 2/2014 |
| JP | 2015-028200 | A | 2/2015 |
| JP | 2015-193907 | A | 11/2015 |
| JP | 2016-130334 | A | 7/2016 |
| JP | 2016-130356 | A | 7/2016 |
| JP | 6388099 | B1 | 9/2018 |
| JP | 2022-515159 | A | 2/2022 |

(Continued)

OTHER PUBLICATIONS

Search Report issued Jun. 29, 2023 for counterpart European Patent Application No. 21757803.8.

Indian Office Action dated Dec. 1, 2023 issued in Indian Patent Application No. 202217044932 (partial English translation).

Office Action issued Apr. 13, 2023 for counterpart Chinese Patent Application No. 202180015228.6 (see English translation).

International Search Report dated May 7, 2021 issued in International Patent Application No. PCT/KR2021/001996 (with English translation).

Japanese Office Action dated Sep. 19, 2023 issued in Japanese Patent Application No. 2022-549291.

*Primary Examiner* — Danielle M. Carda

(74) *Attorney, Agent, or Firm* — Morgan Lewis & Bockius LLP

(57) ABSTRACT

A steel sheet with excellent surface quality, and a manufacturing method therefor are provided. The present invention provides a pickled steel sheet with excellent surface quality, comprising, by wt %, carbon (C) in an amount greater than or equal to 0.05% and less than 0.4%, 0.5% or less of silicon (Si) (excluding 0%), 0.05% or less of phosphorus (P), 0.03% or less of sulfur (S), 0.01% or less of boron (B), 0.1-2.5% of manganese (Mn) and/or chromium (Cr), and the balance of iron (Fe) and inevitable impurities, wherein the average thickness of an internal oxide layer and/or a tantalum layer, which are formed on the surface layer of the steel sheet, is 1-10 μm, and the standard deviation of the thickness of the internal oxide layer and/or the tantalum layer in the length direction of the steel sheet is 2 μm or less.

4 Claims, No Drawings

(56) References Cited

FOREIGN PATENT DOCUMENTS

| | | | |
|---|---|---|---|
| KR | 10-2003-0092356 | A | 12/2003 |
| KR | 10-2012-0074135 | A | 7/2012 |
| KR | 10-2012-0075157 | A | 7/2012 |
| KR | 10-2013-0068402 | A | 6/2013 |
| KR | 10-2014-0050961 | A | 4/2014 |
| KR | 10-2014-0081598 | A | 7/2014 |
| KR | 10-2017-0122723 | A | 11/2017 |
| KR | 10-2019-0001493 | A | 1/2019 |
| KR | 10-2019-0073839 | A | 6/2019 |
| WO | 2016/098963 | A1 | 6/2016 |

* cited by examiner

STEEL SHEET WITH EXCELLENT SURFACE QUALITY, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2021/001996, filed on Feb. 17, 2021, which in turn claims the benefit of Korean Application No. 10-2020-0019925, filed on Feb. 18, 2020, the entire disclosures of which applications are incorporated by reference herein.

TECHNICAL FIELD

The present disclosure relates to a steel sheet with excellent surface quality, and a manufacturing method therefor, and more particularly to a pickled steel sheet and a cold-rolled steel sheet, with excellent surface quality, the pickled steel sheet and the cold-rolled steel sheet having a small deviation of a thickness of an internal oxide layer and a decarburized layer in a length direction of the steel sheet, and a manufacturing method therefor.

BACKGROUND ART

In the case of carbon steel, the following Patent Documents are known, such as suppressing formation of an oxide or a decarburized layer, formed on a surface layer in a manufacturing step to improve surface quality, or using a heat-treatment or a special device to remove the generated oxide or the decarburized layer, formed on the surface layer, are known.

Patent Document 1 discloses a technique for applying a decarburization inhibitor containing carbon to prevent decarburization occurring during hot working of carbon steel, and while this can prevent decarburization in a heating step, it is not preferable to solve a problem of decarburization having occurred during coiling after hot rolling.

Patent Documents 2 and 3 disclose a technique for improving pickling treatment capability by adding an additive containing sulfuric acid as a main component to remove scale generated on a surface of a steel material, but it is different from a technique for uniformly controlling an internal oxide layer, and the like, in a length direction of a coil.

Patent Documents 4 and 5 disclose a technique for removing scale using a heat treatment or induction heating in a decarboxylation reducing atmosphere to effectively remove scale generated on a surface of a steel material, but at is also different from a technique for uniformly controlling the internal oxide layer, and the like, in the length direction of the coil, because there may be costs for manufacturing and using an additional device.

Prior Art Document (Patent Document 1) Japanese Patent Publication No. 1993-123739

(Patent Document 2) Japanese Patent Publication No. 1998-072686

(Patent Document 3) Japanese Patent Publication No. 2004-331994

(Patent Document 4) Japanese Patent Publication No. 1995-070635

(Patent Document 5) Korean Patent Registration No. 10-1428311

SUMMARY OF INVENTION

Technical Problem

An aspect of the present disclosure is to provide a steel sheet with excellent surface quality and a manufacturing method therefor.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, a pickled steel sheet with excellent surface quality is provided. The pickled steel sheet includes, by wt %, 0.05% or more and less than 0.4% of carbon (C), 0.5% or less (excluding 0%) of silicon (Si), 0.05% or less of phosphorus (P), 0.03% or less of sulfur (S), 0.01% or less of boron (B), 0.1 to 2.5% of at least one of manganese (Mn) and chromium (Cr), and a balance of iron (Fe) and inevitable impurities, wherein an average thickness of an internal oxide layer and/or a decarburized layer, formed in a surface layer portion of the steel sheet, is 1 to 10 μm, and a standard deviation of the thickness of the internal oxide layer and/or the decarburized layer in a length direction of the steel sheet is 2 μm or less.

According to another aspect of the present disclosure, a cold-rolled steel sheet with excellent surface quality is provided. The cold-rolled steel sheet includes, by wt %: 0.05% or more and less than 0.4% of carbon (C), 0.5% or less (excluding 0%) of silicon (Si), 0.05% or less of phosphorus (P), 0.03% or less of sulfur (S), 0.01% or less of boron (B), 0.1 to 2.5% of at least one of manganese (Mn) and chromium (Cr), and a balance of iron (Fe) and inevitable impurities, wherein an average thickness of an internal oxide layer and/or a decarburized layer, formed in a surface layer portion of the steel sheet, is 1×[1−cold reduction (%)] μm to 10×[1−cold reduction (%)]μm, and a standard deviation of the thickness of the internal oxide layer and/or the decarburized layer in a length direction of the steel sheet is 2 μm or less.

In addition, the pickled steel sheet and the cold-rolled steel sheet of the present disclosure may satisfy the following Relational Expression 1, $$C(\%)+Si(\%)/6+Mn(\%)/20+Cr(\%)/20+2\times P(\%)+4\times S(\%)<0.5. \quad \text{[Relational Expression 1]}$$

According to another aspect of the present disclosure, a manufacturing method for a pickled steel sheet with excellent surface quality is provided. The manufacturing method for a pickled steel sheet includes operations of: preparing a hot-rolled coil including, by wt %, 0.05% or more and less than 0.4% of carbon (C), 0.5% or less (excluding 0%) of silicon (Si), 0.05% or less of phosphorus (P), 0.03% or less of sulfur (S), 0.01% or less of boron (B), 0.1 to 2.5% of at least one of manganese (Mn) and chromium (Cr), and a balance of iron (Fe) and inevitable impurities; and removing an internal oxide layer and/or a decarburized layer in a surface layer portion by immersing the hot-rolled coil in a pickling tank and passing the same therethrough, wherein, when the hot-rolled coil is divided into a first region, a second region, a third region, a fourth region, and a fifth region, in a length direction, a pickling tank passing speed of a hot-rolled coil corresponding to the second region, the third region, and the fourth region is controlled to be slower than a pickling tank passing speed of a hot-rolled coil corresponding to the first region and the fifth region.

According to an aspect of the present disclosure, a manufacturing method for a cold-rolled steel sheet with excellent surface quality is provided. The manufacturing method for a cold-rolled steel sheet includes operations of: preparing a hot-rolled coil including, by wt %, 0.05% or more and less than 0.4% of carbon (C), 0.5% or less (excluding 0%) of silicon (Si), 0.05% or less of phosphorus (P), 0.03% or less of sulfur (S), 0.01% or less of boron (B), 0.1 to 2.5% of at least one of manganese (Mn) and chromium (Cr), and a balance of iron (Fe) and inevitable impurities; removing an internal oxide layer and/or a decarburized layer in a surface layer portion by immersing the hot-rolled coil in a pickling tank and passing the same therethrough; and cold rolling the hot-rolled steel sheet from which the internal oxide layer and/or the decarburized layer have been removed, wherein, when the hot-rolled coil is divided into a first region, a second region, a third region, a fourth region, and a fifth region, a pickling tank passing speed of a hot-rolled coil corresponding to the second region, the third region, and the fourth region is controlled to be slower than a pickling tank passing speed of a hot-rolled coil corresponding to the first region and the fifth region.

Advantageous Effects of Invention

In the present disclosure having the configuration as described above, it is possible to provide a carbon steel sheet with excellent surface quality in which an internal oxide layer, or the like, is uniformly formed in a length direction of a steel sheet, and a manufacturing method therefor. In particular, additional costs may not be incurred through additional processes or equipment, but rather productivity of pickling may be improved compared to the existing methods, thereby reducing manufacturing costs.

BEST MODE FOR INVENTION

Hereinafter, the present disclosure will be described.

In general, as is well known, in a surface layer portion of a hot-rolled coil manufactured through conventional reheating, finishing rolling, cooling, and coiling, there is an internal defect layer such as an internal oxide layer and/or a decarburized layer. The internal oxide layer may occur in a process in which components such as chromium (Cr), manganese (Mn), silicon (Si), zinc (Zn), magnesium (Mg), and aluminum (Al), which have higher oxygen affinity, than iron. (Fe) occurs oxidation na base material. The decarburized layer may occur process of being discharged to an atmosphere in a form of a gas after carbon in steel is combined with the atmosphere and oxygen in scale, and a thickness of the internal defect layer may vary depending on a composition of a hot-rolled steel sheet, a temperature when a hot-rolled steel sheet is wound with a hot-rolled coil (HC), a cooling time after coiling, a width, a thickness, and a length of the hot-rolled steel sheet, and the like, and may be within 50 μm.

Meanwhile, the internal defect layer also affects a subsequent pickling process and a cold-rolling process, thereby ultimately becoming a factor to deteriorate surface properties of the finally manufactured steel sheet. Accordingly, in the present disclosure, by providing optimum pickling conditions, using a hot-rolled coil showing thickness deviation such as the internal oxide layer, or the like, a pickled steel sheet and a cold-rolled steel sheet with excellent surface quality may be provided.

Hereinafter, a pickled steel sheet and a cold-rolled steel sheet of the present disclosure will be described.

First, in the pickled steel sheet and cold-rolled steel sheet of the present disclosure, a steel sheet is used, the steel sheet including, by weight %, 0.05% or more and less than 0.4% of carbon (C), 0.5% or less (excluding 0%) of silicon (Si), 0.05% or less of phosphorus (P), 0.03% or less of sulfur (S), 0.01% or less of boron (B), 0.1 to 2.5% of manganese (Mn) and/or chromium (Cr), and a balance of iron (Fe) and inevitable impurities. Hereinafter, the steel composition component of the present disclosure and the reason for limiting its content will be described. Meanwhile, "%" as used herein means "%" by weight, unless otherwise specified.

Carbon (C): 0.05% or More and Less than 0.4%

Carbon (C) is an element that effectively contributes to m-proving strength of steel, so that in the present disclosure, a certain level or more of carbon (C) may be included in order to secure strength of a high carbon steel sheet. In addition, when a content of C is less than a certain level, a desired strength, hardness, and durability fa final part cannot be ensured and a function of the high carbon steel sheet cannot be obtained, so in the present disclosure, a lower limit of the content of carbon (C) may be limited to 0.05%. On the other hand, when carbon (C) is excessively added, the strength is improved, but cracks occur during a manufacturing process thereof or cracks also occur on a surface thereof due to formation of excessive cementite, which may cause a problem of deterioration of surface quality, and deterioration of weldability. Therefore, in the present disclosure, the content of carbon (C) may be limited to less than 0.4%. Accordingly, the content of carbon (C) in the present disclosure may be in a range of 0.05% or more and less than 0.4%.

Silicon (Si): 0.5% or Less (Excluding 0%)

Silicon (Si) is an element having a strong affinity with oxygen, so when a large amount of Si is added, it is not preferable because it may cause surface defects observed with a naked eye by a surface scale such as a red scale. Accordingly, in the present disclosure, an upper limit of a content of silicon (Si) may be limited to 0.5%. However, since silicon (Si) is an element not only acting as a deoxidizer but also contributing to improving strength of steel, in the present disclosure, 0% may be excluded from a lower limit of the content of silicon (Si).

Phosphorus (P): 0.05% or Less

Phosphorus (P) is a major element that segregates at grain boundaries and causes a decrease in toughness of steel. Therefore, it is preferable to control a content of phosphorus (P) as low as possible. Therefore, it is theoretically most advantageous to limit the content of phosphorus (P) to 0%. However, since phosphorus (P) is an impurity that is unavoidably introduced into steel during a steelmaking process, and an excessive process load may be caused to control the content of phosphorus (P) to 0%. Accordingly, in the present disclosure, in consideration of this point, an upper limit of the content of phosphorus (P) may be limited to 0.05%.

Sulfur (S): 0.03% or Less

Sulfur (S) is a major element forming Mns, increasing an amount of precipitates, and embrittling steel. Therefore, it is preferable to control a content of sulfur (S) as low as possible. Therefore, it is theoretically most advantageous to limit the content of sulfur (S) to 0%. However, sulfur (S) is also an impurity that is unavoidably introduced into steel during a steelmaking process, and an excessive process load may be caused to control the content of sulfur (S) to 0%. Accordingly, in the present disclosure, an upper limit of the content of sulfur (S) may be limited to 0.03% in consideration of this point.

Boron (B): 0.01% or Less

Boron (B) is an element that slows a transformation rate, when being transformed from austenite to ferrite, pearlite, bainite, or the like, and is an element that is easy to control transformation through cooling. However, when an excessive amount of boron (B) is added, B segregates at grain boundaries and causes deterioration of strength, ductility, toughness, and the like. Accordingly, a content of boron (B) is preferably 0.01% or less.

At least one of manganese (Mn) and chromium (Cr): 0.1% or more and less than 2.5%

Manganese (Mn) and chromium (Cr) are elements contributing to forming hardenability of steel, so in the present disclosure, manganese (Mn) and chromium (Cr) may be included to achieve this effect. However, excessive addition of manganese (Mn) and chromium (Cr), which are expensive elements, is not preferable from an economic point of view, and when an excessive amount of manganese (Mn) and chromium (Cr) is added, weldability may be deteriorated. Therefore, in the present disclosure, a content of at least one of manganese (Mn) and chromium (Cr) may be in a range of 0.1% or more and less than 2.5%.

[Relational Expression 1]

It is preferable that the pickled steel sheet and the cold-rolled steel sheet of the present disclosure contain C, Si, Mn, Cr, P and S so as to satisfy the following Relational Expression 1. A reason for defining the following Relational Expression 1 in the present disclosure is that the elements described above causes deterioration of weldability. If a sum of the contents of the component elements defined by the following Relational Expression 1 is 0.5 or more, there is a problem in that weldability is deteriorated and cracks are generated around a welded part.

$$C(\%)+Si(\%)/6+Mn(\%)/20+Cr(\%)/20+2\times P(\%)+4\times S(\%)<0.5 \quad \text{[Relational Expression 1]}$$

In the present disclosure, in addition to the steel composition described above, a remainder may include Fe and inevitable impurities. Inevitable impurities may be inevitably added in a typical steel manufacturing process, and it cannot be completely excluded, and those skilled in the ordinary steel manufacturing field can easily understand the meaning. In addition, in the present disclosure, addition of a composition, other than the steel composition described above, does not entirely be excluded.

In the pickled steel sheet of the present disclosure, an average thickness of an internal oxide layer and/or a decarburized layer formed on a surface layer of a steel sheet is required to be in a range of 1 to 10 μm. If the thickness is less than 1 μm, the internal oxide layer and/or the decarburized layer are removed in large amounts or all are removed to an uncontrollable level. In this case, there is a problem in that pickling productivity is deteriorated as well as consumption of the steel sheet removed due to pickling increases. Meanwhile, if the thickness thereof exceeds 10 μm, the internal oxide layer and/or the decarburized layer remaining on the surface thereof are left thick, so that there is a problem of deteriorating surface quality such as durability, or the like.

Meanwhile, in the present disclosure, the thickness of the internal oxide layer and/or the decarburized layer is obtained by measuring a cross-section of the steel sheet with an optical microscope or an electron microscope (SEM), and the average thickness is obtained by measuring at least five locations in the length direction of the steel sheet, to obtain an average value thereof. That is, in the present disclosure, the thickness of the internal oxide layer and/or the decarburized layer is obtained by measuring a cross-section of the steel sheet with an optical microscope or electron microscope (SEM), and the decarburized layer is divided into a base material layer and a decarburized layer by measuring a cross-section corroded using a corrosion solution such as nital, or the like, and the internal oxide layer is divided into a base material layer and an internal oxide layer by being directly observed from the cross-section thereof without corrosion. In this case, the average thickness of the internal oxide layer and/or the decarburized layer is obtained by measuring at least five locations in the length direction of the steel sheet, to obtain an average value thereof. A measurement position in the length direction of the steel sheet is measured by taking one or more samples from each region, when a coil is equally divided into 5 equal regions in the length direction. In addition, the standard deviation is obtained by calculating a standard deviation value for data at five or more locations in the length direction of the steel sheet measured above.

Meanwhile, in the cold-rolled steel sheet of the present disclosure, the average thickness of the internal oxide layer and/or decarburized layer formed in the surface layer portion of the steel sheet satisfies has a range of 1×[1−cold reduction (%)]μm to 10×[1−cold reduction (%)]μm. That is, the thickness of the internal oxide layer and/or the decarburized layer formed in the surface layer portion of the steel sheet is also reduced according to a reduction during cold rolling. Preferably, the average thickness of the internal oxide layer and/or decarburized layer formed on the surface layer portion of the cold-rolled steel sheet is controlled to be in a range of 0.2 to 8 μm.

In addition, in the pickled steel sheet and cold-rolled steel sheet of the present disclosure, the standard deviation of the thickness of the internal oxide layer and/or decarburized layer in the length direction of the steel sheet satisfies within 2 μm. If the standard deviation of the thickness exceeds 2 μm, a deviation of surface quality occurs for each location, and a deviation in an amount removed through pickling occurs, so that there is a problem in that the steel sheet removed through pickling has increased consumption or insufficient removal of the steel sheet, so surface quality thereof is deteriorated. More preferably, the standard deviation of the thickness thereof is limited to 1.6 μm or less.

Next, a manufacturing method for a pickled steel sheet and a cold-rolled steel sheet with excellent surface quality according to the present disclosure will be described.

First, in the present disclosure, a hot-rolled coil is prepared.

First, a steel sheet including, by wt %: 0.05% or more and less than 0.4% of carbon (C), 0.5% or less of silicon (Si) (excluding 0%), 0.05% or less of phosphorus (P), 0.03% or less of sulfur (S), 0.01% or less of boron (B), 0.1 to 2.5% of at least one of manganese (Mn) and chromium (Cr), and a balance of iron (Fe) and inevitable impurities, is used.

In addition, the present disclosure is not limited to a specific manufacturing process for manufacturing the hot-rolled coil, and a general manufacturing process may be used. Specifically, the general manufacturing process may include operations of: reheating a slab provided with the above-described steel composition; providing a hot-rolled steel sheet by hot rolling the reheated slab; cooling the hot-rolled hot-rolled steel sheet; coiling the cooled hot-rolled steel sheet; and cooling the coiled coil.

As an example, a hot-rolled coil may be manufactured using the following manufacturing processes.

Reheating and Hot Rolling a Slab

A slab prepared by the conventional slab manufacturing process may be reheated in a certain temperature range. For a sufficient homogenization treatment, a lower limit of a reheating temperature may be limited to 1050° C., and an upper limit of the reheating temperature may be limited to 1350° C. in consideration of economic feasibility and surface quality.

Then, the reheated slab may be rough-rolled by a conventional method, and the rough-rolled steel slab may be not rolled to a thickness of 1.5 mm to 10 mm by finishing hot-rolling. In the present disclosure, hot rolling may be performed under conventional conditions, but a finishing rolling temperature for controlling a rolling load and reducing surface scale may be in a range of 800 to 950° C.

Cooling and Coiling

Control cooling may be performed on a hot-rolled steel sheet immediately after hot rolling.

In the present disclosure, since surface quality of the hot-rolled steel sheet is strictly controlled, it is preferable that cooling in the present disclosure is started within 5 seconds. When a time from hot rolling to a start of cooling exceeds 5 seconds, an internal oxide layer and/or a decarburized layer, which is not intended by the present disclosure, may be formed on a surface layer of the steel sheet, by air cooling in an atmosphere. A more preferable time from hot rolling to the start of cooling may be within 3 seconds.

In addition, the hot-rolled steel sheet immediately after hot rolling may be cooled to a coiling temperature of 500° C. or more and 750° C. or less at a cooling rate of 10 to 1000° C./s. When the cooling rate is less than 10° C./s, an internal oxide layer and/or a decarburized layer may be formed on a surface layer of the steel sheet during cooling, so there is a problem in that surface quality desired by the present disclosure cannot be secured. Although, in the present disclosure, an upper limit of the cooling rate is not specifically limited to secure the desired surface quality, the upper limit of the cooling rate may be limited to 1000° C./s in consideration of facility limitations and economic feasibility. In addition, when the coiling temperature is less than 500° C., a low-temperature transformation structure such as bainite or martensite may be formed to cause cracks in the steel sheet. When the coiling temperature exceeds 750° C., an excessively large amount of an internal oxide layer and/or a decarburized layer may be formed on the surface layer of the steel sheet, so there is a problem in that the surface quality desired by the present disclosure cannot be secured.

Cooling the Wound Coil

The wound coil is cooled in air. In this case, in a high carbon hot-rolled steel sheet, an oxide and/or decarburized layer is additionally formed directly below a surface as well as a scale layer formed on the surface layer. The oxide and/or decarburized layer formed directly below the surface layer are formed to have different depths in front and rear end portions and in a central portion in a length direction of the hot-rolled steel sheet. This is because the temperature in the front and rear end portions and in the central portion is different, when the hot-rolled coil is cooled in a wound state. The oxide and decarburized layers directly below the surface of in the front and rear end portions and the central portion may have a depth of 0 to 5 μm and 3 to 20 μm, respectively.

In the hot-rolled steel sheet prepared by the above manufacturing method, the internal oxide layer and/or the decarburized layer formed on the surface layer may be formed to have an average thickness of 2 to 20 μm.

In the present disclosure, the internal oxidation layer and/or the decarburized layer of the surface layer are removed by immersing the hot-rolled coil in the pickling solution of the pickling tank and passing the same therethrough.

In this case, in the present disclosure, when the hot-rolled coil is divided into a first region, a second region, a third region, a fourth region, and a fifth region, in a length direction, a pickling tank passing speed of a hot-rolled coil corresponding to the second region, the third region, and the fourth region is controlled to be slower than a pickling tank passing speed of a hot-rolled coil corresponding to the first region and the fifth region. In addition, it is preferable to control the pickling tank passing speed of the hot-rolled coil corresponding to the third region to be slower than the pickling tank passing speed of the hot-roiled coil corresponding to the second and fourth regions. Thereby, it is possible to obtain a pickled steel sheet having a reduced thickness deviation in the length direction through pickling treatment despite the thickness deviation by length of the internal oxide layer and/or the decarburized layer formed on the hot-rolled coil. In the present disclosure, the thickness of the internal oxide layer and/or the decarburized layer in the third region is the thickest, and the division may be equal division.

More preferably, a pickling tank passing speed of a hot-rolled coil in the third region is 5 mpm to 50 mpm, an average pickling tank passing speed of thereof in the first region and the fifth region is controlled to be 5×[pickling tank passing speed of the hot-rolled coil in the third region]×1/2 to 5×[pickling tank passing speed of the hot-rolled coil in the third region]×2, and a pickling tank passing speed of a hot-rolled coil in the second region and the fourth region is controlled to be 5×[pickling tank passing speed of the hot-rolled coil in the third region/2]×1/2 to 5×[pickling tank passing speed of the hot-rolled coil in the third region/2]×2.

The pickling tank passing speed of the hot-rolled coil in the third region needs to be maintained at 50 mpm or less in order to effectively remove the oxide and the decarburized layer directly below the surface. Meanwhile, if the passing speed thereof is too low, an amount of steel sheet removed through pickling increases due to overpickling, and a pickling rate is slow and productivity is deteriorated, so that it is preferable that the speed is controlled to be 5 mpm or more.

The pickling tank passing speed of the hot-rolled coil in the first region and the fifth region may be controlled to be faster than that in the third region, and the speed thereof may be required to be controlled to 5×[pickling tank passing speed of the hot-rolled coil in the third region]×1/2 to 5×[pickling tank passing speed of the hot-rolled coil in the third region]×2, based on the pickling tank passing speed of the hot-rolled coil in the third region. It is also preferable to control the oxide and the decarburized layer directly below the surface to a range that does not deteriorate productivity and effectively remove the oxide and the decarburized layer.

The pickling tank passing speed of the hot-rolled coil in the second region and fourth region may be controlled to be faster than that in the third region, and it is necessary that the speed is controlled to be 5×[pickling tank passing speed of the hot-rolled coil in the third region/2]×1/2 to 5×[pickling tank passing speed of the hot-rolled coil in the third region/2]×2. It is preferable that the oxide and the decarburized layer directly below the surface to a range that effectively removes the oxide and the decarburized layer and does not reduce productivity.

In addition, in the present disclosure, when the hot-rolled coil is divided into n regions in the length direction, at is more preferable that a pickling tank passing speed of the hot-rolled coil, corresponding to a (n/2)th region, the region in which the thickness of the internal oxide layer and/or the decarburized layer is the thickest, is 5 mpm to 50 mpm, in the case of t≤(n/2), the a pickling tank passing speed of the hot-rolled coil corresponding to each region is controlled by the following Relational Expression 2, and in the case of t>(n/2), the pickling tank passing speed of the hot-rolled coil corresponding to each region is controlled by the following Relational Expression 3.

[Relational Expression 2]

Pickling tank passing speed of the hot-rolled coil corresponding to a $t^{th}$ region=n×[pickling tank passing speed of the hot-rolled coil corresponding to the $(n/2)^{th}$ region/t]×1/2 to n×[pickling tank passing speed of the hot-rolled coil corresponding to the $(n/2)^{th}$ region/t]×2

[Relational Expression 3]

Pickling tank passing speed of the hot-rolled coil corresponding to the $t^{th}$ region=n×[pickling tank passing speed of the hot-rolled coil corresponding to the $(n/2)^{th}$ region/(n−t+1)]×1/2 to n×[pickling tank passing speed of the hot-rolled coil corresponding to the $(n/2)^{th}$ region/(n-t+1)]×2 where, in Relational Expressions 2 to 3, n is a natural number, and the $t^{th}$ refers to an order sequentially assigned to correspond to each region divided in the length direction of the hot-rolled coil.

Meanwhile, in a pickling process of the present disclosure, an internal oxide layer and/or a decarburized layer formed on a surface layer may be efficiently removed by controlling a concentration of acid and a temperature of a pickling solution in a pickling tank as well as the pickling rate described above.

Specifically, a concentration of hydrochloric acid in the pickling solution may be 5 to 25%. When a concentration of hydrochloric acid is less than 5%, there is a problem that a pickling ability is lowered, and when the concentration of hydrochloric acid exceeds 25%, there is a problem in that the concentration of hydrochloric acid is high, resulting in overpickling or increased costs.

The temperature of the pickling solution may be 70° C. to 90° C. When the acid temperature is less than 70° C., there is a problem in that the pickling ability is lowered, and when the acid temperature is 90° C. or more, there is a problem of overpicking or increased consumption due to evaporation.

Through the pickling treatment as described above, a high carbon pickled steel sheet with excellent surface quality may be provided. In the high carbon pickled steel sheet, an average thickness of an internal oxide layer and/or a decarburized layer formed on a surface layer thereof is 1 to 10 μm, a standard deviation of the thickness of the internal oxide layer and/or decarburized layer in a length direction is 2 μm or less, and more preferably, the standard deviation of the thickness thereof is 1 μm or less.

Subsequently, in the present disclosure, a cold-rolled steel sheet may be prepared by cold rolling the pickled steel sheet.

A reduction of the cold rolling may be 10% to 80% depending on the strength and thickness requirements of a final product. In the case of cold rolling performed described above, an average thickness of the oxide layer and the decarburized layer directly below a surface of the pickled steel sheet decreases in proportion to a reduction. That is, the thickness of the internal oxide layer and the decarburized layer of the cold-rolled steel sheet may be [thickness of the internal oxide layer and the decarburized layer of the pickled steel sheet]×cold reduction (%)/100.

Therefore, in the cold-rolled steel sheet of the present disclosure, the average thickness of the internal oxide layer and/or the decarburized layer formed on the surface layer of the steel sheet may satisfy 1×[1-cold reduction (%)]μm to 10×[1−cold reduction (%)]μm.

Preferably, the average thickness of the internal oxide layer and/or decarburized layer formed on the surface layer of the cold-rolled steel sheet satisfies a range of 0.2 to 8 μm, Meanwhile, the standard deviation of the thickness of the internal oxide layer and/or the decarburized layer in the length direction of the cold-rolled steel sheet may be maintained at 2 μm or less, more preferably 1.6 μm or less, as in the above-described pickled steel sheet.

MODE FOR INVENTION

Hereinafter, the present disclosure will be described in detail through Examples. The present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

Example

After preparing a hot-rolled coil having the composition shown in Table 1 below, a pickled steel sheet and a cold-rolled steel sheet were prepared using the conditions shown in Table 2 below. Each hot-rolled coil was manufactured using a conventional manufacturing method. That is, a steel slab having the composition shown in Table 1 below was reheated in a temperature range of 1050 to 1350° C. and then rough rolled, and then, the rough-rolled steel slab was finishing hot rolled in a temperature range of 800 to 950° C. Thereafter, the finishing hot-rolled hot-rolled steel sheet was cooled to a temperature range of 500 to 750° C. at a cooling rate of 10 to 1000° C./s, then coiled, and then, the coiled hot-rolled coil was air-cooled.

Each of the prepared hot-rolled coils was immersed in a pickling tank under the conditions in Table 2 below to be pickled, so that an internal oxide layer and/or a decarburized layer formed on a surface thereof was removed to prepare a pickled steel sheet. Specifically, when each of the prepared hot-rolled coils is divided into 5 parts in a length direction in a first region, a second region, a third region, a fourth region, and a fifth region, a speed at which the hot-rolled coil for each region passes through a pickling tank was controlled as shown in Table 2 below to prepare a pickled steel sheet.

Thereafter, an average thickness (μm) of an internal oxide layer and/or a decarburized layer of a pickled steel sheet from which the internal oxide layer and/or the decarburized layer on a surface thereof have been removed after being discharged from the pickling tank was measured with respect to an average thickness (μm) of an internal oxide layer and/or a decarburized layer of a hot-rolled coil before pickling and the results were shown in Table 3 below. In this case, a standard deviation (μm) of the thickness of the internal oxide layer and/or the decarburized layer in the length direction of the pickled steel sheet was also measured and shown in Table 3 below.

Meanwhile, in the present invention, a cold-rolled steel sheet was also manufactured by cold-rolling the prepared pickled steel sheet under the conditions shown in Table 2 below. The average thickness (μm) of the internal oxide layer and/or the decarburized layer of each of the prepared cold-rolled steel sheets was measured with respect to an average thickness (μm) of the internal oxide layer and/or decarburized layer of the hot-rolled coil before pickling, and the results were shown in Table 3 below. In this case, a standard deviation (μm) of the thickness of the internal oxide layer and/or the decarburized layer in a length direction of the cold-rolled steel sheet was also measured and shown in Table 3 below.

Here, a specific method for measuring the average thickness (μm) and standard deviation (μm) of the internal oxide layer and/or the decarburized layer is as follows. First, the thickness of the internal oxide layer and/or the decarburized layer is obtained by measuring a cross-section of a steel sheet with an optical microscope or electron microscope (SEM), and the decarburized layer is divided into a base material layer and a decarburized layer by measuring a cross-section corroded using a corrosion solution such as nital, or the like, and the internal oxide layer is divided into a base material layer and an internal oxide layer by being directly observed from the cross-section thereof without corrosion. In this case, the average thickness of the internal oxide layer and/or the decarburized layer is obtained by measuring at least five locations in the length direction of the steel sheet and an average value thereof is calculated, a measurement position of the steel sheet in the length direction is measured by taking one or more samples in each region, when the coil is equally divided into 5 equal regions in the length direction. In addition, the standard deviation is obtained by calculating a standard deviation value for data at least five locations in the length direction of the steel plate measured thereabove.

TABLE 1

| Steel | Composition of hot-rolled coil(weight %) | | | | | | | |
|---|---|---|---|---|---|---|---|---|
| type | C | Si | P | S | B | Mn | Cr | Balance |
| 1 | 0.08 | 0.07 | 0.010 | 0.003 | 0.0020 | 0.40 | 0.25 | Fe and impurities |
| 2 | 0.15 | 0.06 | 0.015 | 0.003 | 0.0015 | 0.40 | 0.45 | |
| 3 | 0.22 | 0.08 | 0.012 | 0.004 | 0.0017 | 0.43 | 0.25 | |
| 4 | 0.35 | 0.06 | 0.014 | 0.003 | 0.0016 | 0.40 | 0.40 | |
| 5 | 0.02 | 0.07 | 0.011 | 0.004 | 0.0015 | 0.41 | 0.09 | |
| 6 | 0.5 | 0.07 | 0.012 | 0.003 | 0.0016 | 0.40 | 0.23 | |

TABLE 2

| Steel type | Pickling tank passing speed in a first region (mpm) | Pickling tank passin speed in a second region (mpm) | Pickling tank passing speed in a third region (mpm) | Pickling tank passing speed in a fourth region (mpm) | Pickling tank passing speed in a fifth region (mpm) | Concentration of hydrochloric acid (%) | Temperature of pickling solution (° C.) | Cold reduction (%) | Reference |
|---|---|---|---|---|---|---|---|---|---|
| 1 | 60 | 40 | 20 | 40 | 60 | 15 | 80 | 50 | Inventive Example 1 |
| 2 | 30 | 20 | 10 | 20 | 30 | 15 | 80 | 50 | Inventive Example 2 |
| 2 | 50 | 25 | 10 | 25 | 50 | 15 | 80 | 50 | Inventive Example 3 |
| 2 | 70 | 40 | 10 | 40 | 70 | 15 | 80 | 50 | Inventive Example 4 |
| 2 | 50 | 40 | 20 | 40 | 50 | 15 | 80 | 50 | Inventive Example 5 |
| 2 | 50 | 25 | 10 | 25 | 50 | 20 | 80 | 50 | Inventive Example 6 |
| 2 | 50 | 25 | 10 | 25 | 50 | 15 | 85 | 50 | Inventive Example 7 |
| 2 | 50 | 25 | 10 | 25 | 50 | 15 | 80 | 20 | Inventive Example 8 |
| 2 | 50 | 25 | 10 | 25 | 50 | 15 | 80 | 70 | Inventive Example 9 |
| 3 | 50 | 25 | 10 | 25 | 50 | 15 | 80 | 50 | Inventive Example 10 |
| 4 | 50 | 25 | 10 | 25 | 50 | 15 | 80 | 50 | Inventive Example 11 |
| 2 | 10 | 10 | 10 | 10 | 10 | 15 | 80 | 50 | Comparative Example 1 |
| 2 | 50 | 50 | 50 | 50 | 50 | 15 | 80 | 50 | Comparative Example 2 |
| 5 | 50 | 25 | 10 | 25 | 50 | 15 | 80 | 50 | Comparative Example 3 |
| 6 | 50 | 25 | 10 | 25 | 50 | 15 | 80 | 50 | Comparative Example 4 |
| 2 | 5 | 5 | 5 | 5 | 5 | 15 | 80 | 50 | Conventional Example |

TABLE 3

| Steel type | Average thickness of internal oxide layer/ decarburized layer of hot-rolled steel sheet (μm) | Average thickness of internal oxide layer/ decarburized layer of pickled steel sheet (μm) | Standard deviation of thickness of internal oxide layer and decarburized layer length direction of pickled steel sheet (μm) | Average thickness of internal oxide layer/ decarburized layer of cold-rolled steel steel sheet (μm) | Standard deviation thickness of of internal oxide layer and decarburized layer in length direction of cold-rolled steel sheet (μm) | Weldability index | Reference |
|---|---|---|---|---|---|---|---|
| 1 | 8.7 | 4.7 | 0.6 | 2.3 | 0.5 | 0.147 | Inventive Example 1 |
| 2 | 12.0 | 6.0 | 1.1 | 2.5 | 0.6 | 0.237 | Inventive Example 2 |
| 2 | 11.2 | 7.0 | 1.1 | 3.2 | 0.9 | 0.237 | Inventive Example 3 |
| 2 | 11.5 | 8.3 | 1.2 | 3.7 | 0.9 | 0.237 | Inventive Example 4 |
| 2 | 9.9 | 7.0 | 1.0 | 4.1 | 0.7 | 0.237 | Inventive Example 5 |
| 2 | 10.3 | 5.9 | 1.4 | 2.8 | 0.5 | 0.237 | Inventive Example 6 |
| 2 | 10.3 | 5.2 | 1.1 | 3.3 | 0.6 | 0.237 | Inventive Example 7 |
| 2 | 10.4 | 6.4 | 1.4 | 5.0 | 1.0 | 0.237 | Inventive Example 8 |
| 2 | 9.4 | 6.4 | 1.5 | 1.8 | 0.4 | 0.237 | Inventive Example 9 |
| 3 | 12.1 | 7.2 | 1.3 | 3.7 | 0.9 | 0.297 | Inventive Example 10 |
| 4 | 13.3 | 8.6 | 1.4 | 4.9 | 1.0 | 0.432 | Inventive Example 11 |
| 2 | 10.3 | 5.0 | 3.6 | 2.7 | 2.1 | 0.237 | Comparative Example 1 |
| 2 | 12.7 | 9.1 | 3.4 | 4.9 | 3.0 | 0.237 | Comparative Example 2 |
| 5 | 9.4 | 7.9 | 6.0 | 6.6 | 3.8 | 0.565 | Comparative Example 3 |
| 6 | 12.5 | 9.2 | 2.3 | 4.6 | 2.5 | 0.920 | Comparative Example 4 |
| 2 | 10.2 | 0.0 | 0.0 | 0.0 | 0.0 | 0.237 | Conventional Example |

As shown in Table 1 to 3, in Inventive Examples 1 to 11, satisfying both the alloy composition and manufacturing conditions of the present disclosure, it can be confirmed that an average thickness an internal oxide layer and/or a decarburized layer of a hot-rolled steel sheet, an average thickness of an internal oxide layer and/or a decarburized layer of a pickled steel sheet, a standard deviation of a thickness of an internal oxide layer and/or a decarburized layer in a length direction of the pickled steel sheet, an average thickness of an internal oxide layer and/or a decarburized layer of a cold-rolled steel sheet, and a standard deviation of a thickness of an internal oxide layer and/or a decarburized layer in a length direction of the cold-rolled steel sheet, all satisfy the required range.

On the other hand, in Comparative Examples 1 to 2 in which a pickling tank passing speed is uniformly controlled, the average thickness of the internal oxide layer and/or the decarburized layer of the pickled steel sheet and the cold-rolled steel sheet was evaluated to a desired level, but it can be seen that the standard deviation of the thickness of the internal oxide layer and/or the decarburized layer in a length direction of the pickled steel sheet and the cold-rolled steel sheet is excessively high, so that uniform surface quality may not be ensured.

In addition, in Comparative Example 3 to 4, in Comparative Examples 3 to 4, it can be confirmed that a weldability index value defined in Relational Expression 1 is excessive, so that weldability is deteriorated.

Meanwhile, in Conventional Example, in which a pickling tank passing speed is constantly controlled at an excessively low speed showed a case of an overpickling operation generally performed during pickling treatment, and it can be seen that the internal oxide layer/the decarburized layer of the pickled steel sheet or the cold-rolled steel sheet passing slowly through a pickling tank are entirely removed. However, in this conventional method, there is no problem of surface defects of a product as all the internal oxide layer/the decarburized layer of the pickled steel sheet or the cold-rolled steel sheet are removed, but there is a problem a time of a pickling operation is very long, so that there is a basic problem that it is inefficient and uneconomical.

Hereinafter, the present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

While example embodiments have been shown and described above, it will be apparent to those skilled in the art that modifications and variations could be made without departing from the scope of the present disclosure as defined by the appended claims.

The invention claimed is:

1. A pickled steel sheet, comprising, by wt %:

0.05% or more and less than 0.4% of carbon (C), 0.5% or less and excluding 0% of silicon (Si), 0.05% or less of phosphorus (P), 0.03% or less of sulfur(S), 0.01% or less of boron (B), 0.1 to 2.5% of at least one of manganese (Mn) and chromium (Cr), and a balance of iron (Fe) and inevitable impurities, wherein an average thickness of an internal oxide layer and/or a decarburized layer, formed in a surface layer portion of the steel sheet, is 1 to 10 μm, and a standard deviation of the thickness of the internal oxide layer and/or the decarburized layer in a length direction of the steel sheet is 2 μm or less.

2. The pickled steel sheet of claim 1, wherein the following Relational Expression 1 is satisfied, $$C(\%)+Si(\%)/6+Mn(\%)/20+Cr(\%)/20+2\times P(\%)+4\times S(\%)<0.5. \quad \text{[Relational Expression 1]}$$

3. The pickled steel sheet of claim 1, wherein the standard deviation of the thickness of the internal oxide layer and/or the decarburized layer in the length direction of the steel sheet is 1.6 μm or less.

4. The pickled steel sheet of claim 1, wherein the steel sheet is obtained by immersing a hot-rolled coil in a pickling tank and passing the coil therethrough with a passing speed that is controlled along the coil length such that, when the coil is divided into first through fifth regions in the length direction, the passing speed in the second, third, and fourth regions is slower than the passing speed in the first and fifth regions.

* * * * *